US006526863B2

(12) United States Patent
Torres

(10) Patent No.: US 6,526,863 B2
(45) Date of Patent: Mar. 4, 2003

(54) PROTECTIVE FACE SHIELD WITH INCORPORATED LASER LIGHT

(76) Inventor: Arturo Torres, 13029 El Morado St., La Mirada, CA (US) 90638

( * ) Notice: Subject to any disclaimer, the term of this patent is extended or adjusted under 35 U.S.C. 154(b) by 0 days.

(21) Appl. No.: 09/805,006

(22) Filed: Mar. 12, 2001

(65) Prior Publication Data

US 2002/0124717 A1 Sep. 12, 2002

(51) Int. Cl.[7] ..... F41H 5/08

(52) U.S. Cl. ..... 89/36.05; 135/19.5; 222/78; 362/102

(58) Field of Search ..... 89/36.05, 36.07; 135/19.5; 222/78; 362/102

(56) References Cited

U.S. PATENT DOCUMENTS 2,662,968 A * 12/1953 Saraber ..... 240/1.3
3,728,809 A * 4/1973 Mulich et al. ..... 42/13
4,055,840 A * 10/1977 Uchytil et al. ..... 340/321
4,860,776 A * 8/1989 McQuain ..... 135/19.5
4,962,779 A * 10/1990 Meng ..... 135/16
5,065,904 A * 11/1991 McCaffrey et al. ..... 222/3
5,388,603 A * 2/1995 Bauer et al. ..... 135/16
5,477,431 A * 12/1995 Curameng ..... 362/102
5,502,624 A * 3/1996 Tu ..... 362/102
5,554,816 A * 9/1996 Skaggs et al. ..... 89/36.17
5,690,131 A * 11/1997 Voigt ..... 135/19.5
5,805,226 A * 9/1998 Allen et al. ..... 89/1.11
5,931,562 A * 8/1999 Arato ..... 362/184

* cited by examiner

*Primary Examiner*—Michael J. Carone
*Assistant Examiner*—M. Thomson
(74) *Attorney, Agent, or Firm*—Goldstein & Lavas, P.C.

(57) ABSTRACT

A protective face shield with incorporated laser light including a handle portion having an inner end and an outer end. The outer end has a frustoconical collar extending outwardly therefrom. The frustoconical collar has an open outer end. A laser-generating device is disposed within the frustoconical collar of the handle portion. The laser-generating device has an activated orientation whereby a ray of light is directed outwardly through the open outer end of the frustoconical collar. A protective shield is disposed within the frustoconical collar of the handle portion in a retracted orientation. The protective shield extends outwardly of the collar in a deployed orientation.

6 Claims, 2 Drawing Sheets

PROTECTIVE FACE SHIELD WITH INCORPORATED LASER LIGHT

BACKGROUND OF THE INVENTION

The present invention relates to a protective face shield with incorporated laser light and more particularly pertains to protecting a user's face from an assailant shooting a gun as well as providing means to temporarily blind the assailant.

The use of self-defense devices is known in the prior art. More specifically, self defense devices heretofore devised and utilized for the purpose of providing protection from assailants are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,486,807 to Yanez discloses a self defense weapon comprised of a light source for providing pulses of light to temporarily blind an assailant and includes means to provide a piercing sound and an electric shock. U.S. Pat. No. 2,260,639 to Powell discloses a combination billy club with an integral flashlight. U.S. Pat. No 4,674,394 to Martino discloses a portable bulletproof shield.

While these devices fulfill their respective, particular objective and requirements, the aforementioned patents do not describe a protective face shield with incorporated laser light for protecting a user's face from an assailant shooting a gun as well as providing means to temporarily blind the assailant.

In this respect, the protective face shield with incorporated laser light according to the present invention substantially departs from the conventional concepts and designs of the prior art, and in doing so provides an apparatus primarily developed for the purpose of protecting a user's face from an assailant shooting a gun as well as providing means to temporarily blind the assailant.

Therefore, it can be appreciated that there exists a continuing need for a new and improved protective face shield with incorporated laser light which can be used for protecting a user's face from an assailant shooting a gun as well as providing means to temporarily blind the assailant. In this regard, the present invention substantially fulfills this need.

SUMMARY OF THE INVENTION

In the view of the foregoing disadvantages inherent in the known types of self-defense devices now present in the prior art, the present invention provides an improved protective face shield with incorporated laser light. As such, the general purpose of the present invention, which will be described subsequently in greater detail, is to provide a new and improved protective face shield with incorporated laser light, which has all the advantages of the prior art and none of the disadvantages.

To attain this, the present invention essentially comprises a handle portion having a generally cylindrical configuration. The handle portion has an inner end and an outer end. The outer end has a frustoconical collar extending outwardly therefrom. The frustoconical collar has an open outer end. The handle portion includes a knurled inner gripping portion. A laser-generating device is disposed within the frustoconical collar of the handle portion. The laser-generating device has an activated orientation whereby a ray of light is directed outwardly through the open outer end of the frustoconical collar. A protective shield is disposed within the frustoconical collar of the handle portion in a retracted orientation. The protective shield extends outwardly of the collar in a deployed orientation in a fan-like configuration. The protective shield, in the deployed orientation, forms a concave outer surface having a reflective layer disposed thereon. An activation button is disposed within the inner end of the handle portion. The activation button is in communication with the laser generating device and the protective shield.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved protective face shield with incorporated laser light which has all the advantages of the prior art self defense devices and none of the disadvantages.

It is another object of the present invention to provide a new and improved protective face shield with incorporated laser light, which may be easily and efficiently manufactured and marketed.

It is a further object of the present invention to provide a new and improved protective face shield with incorporated laser light, which is of durable and reliable construction.

An even further object of the present invention is to provide a new and improved protective face shield with incorporated laser light which is susceptible of a low cost of manufacture with regard to both materials and labor, and which accordingly is then susceptible of low prices of sale to the consuming public, thereby making such protective face shield with incorporated laser light economically available to the buying public.

Even still another object of the present invention is to provide a new and improved protective face shield with incorporated laser light for protecting a user's face from an assailant shooting a gun as well as providing means to temporarily blind the assailant.

Lastly, it is an object of the present invention to provide a new and improved protective face shield with incorporated laser light including a handle portion having an inner end and an outer end. The outer end has a frustoconical collar extending outwardly therefrom. The frustoconical collar has an open outer end. A laser-generating device is disposed within the frustoconical collar of the handle portion. The laser-generating device has an activated orientation whereby a ray of light is directed outwardly through the open outer end of the frustoconical collar. A protective shield is disposed within the frustoconical collar of the handle portion in a retracted orientation. The protective shield extends outwardly of the collar in a deployed orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
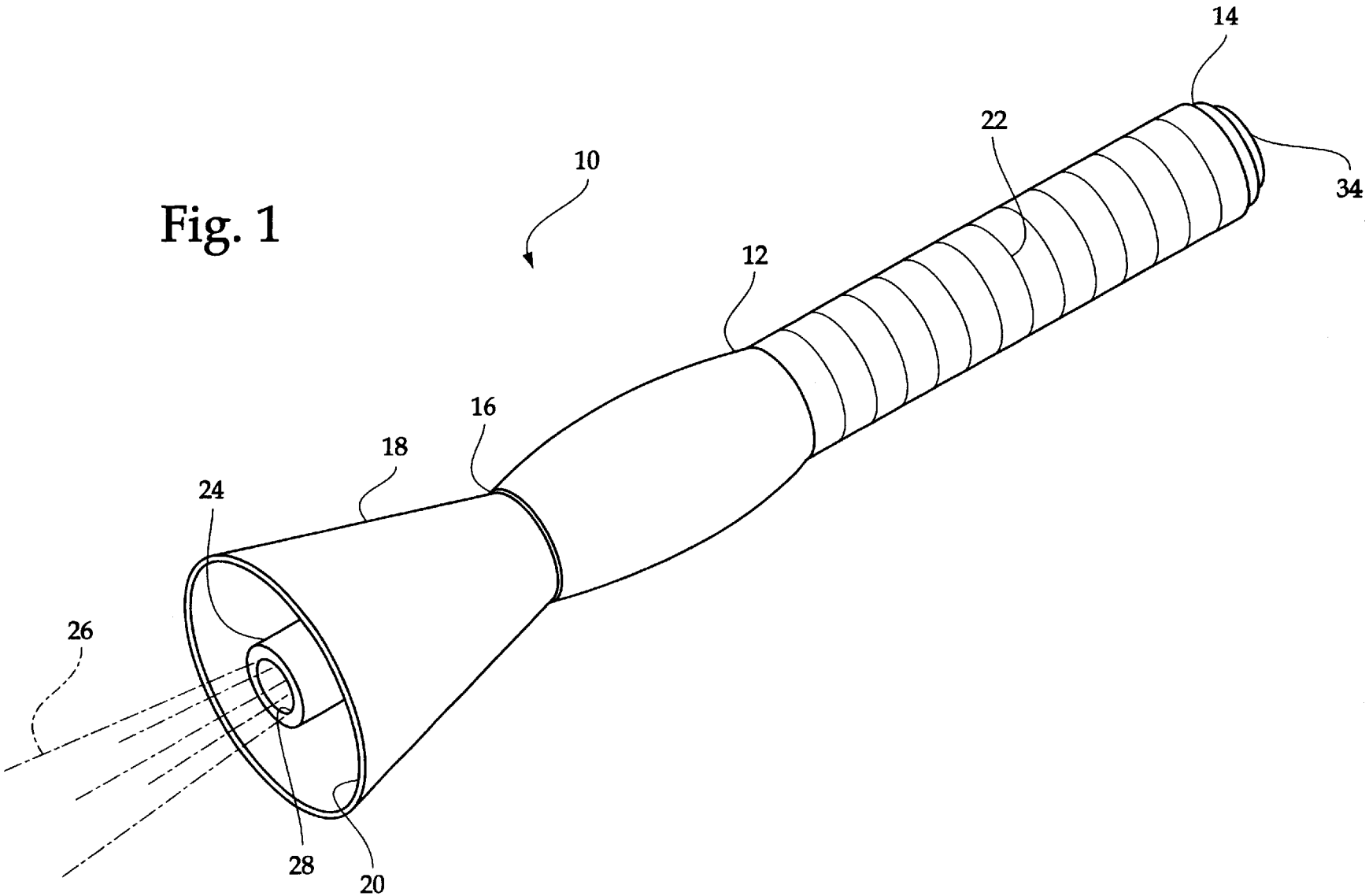
FIG. 1 is a perspective view of the preferred embodiment of the protective face shield with incorporated laser light constructed in accordance with the principles of the present invention.
Figure 2:
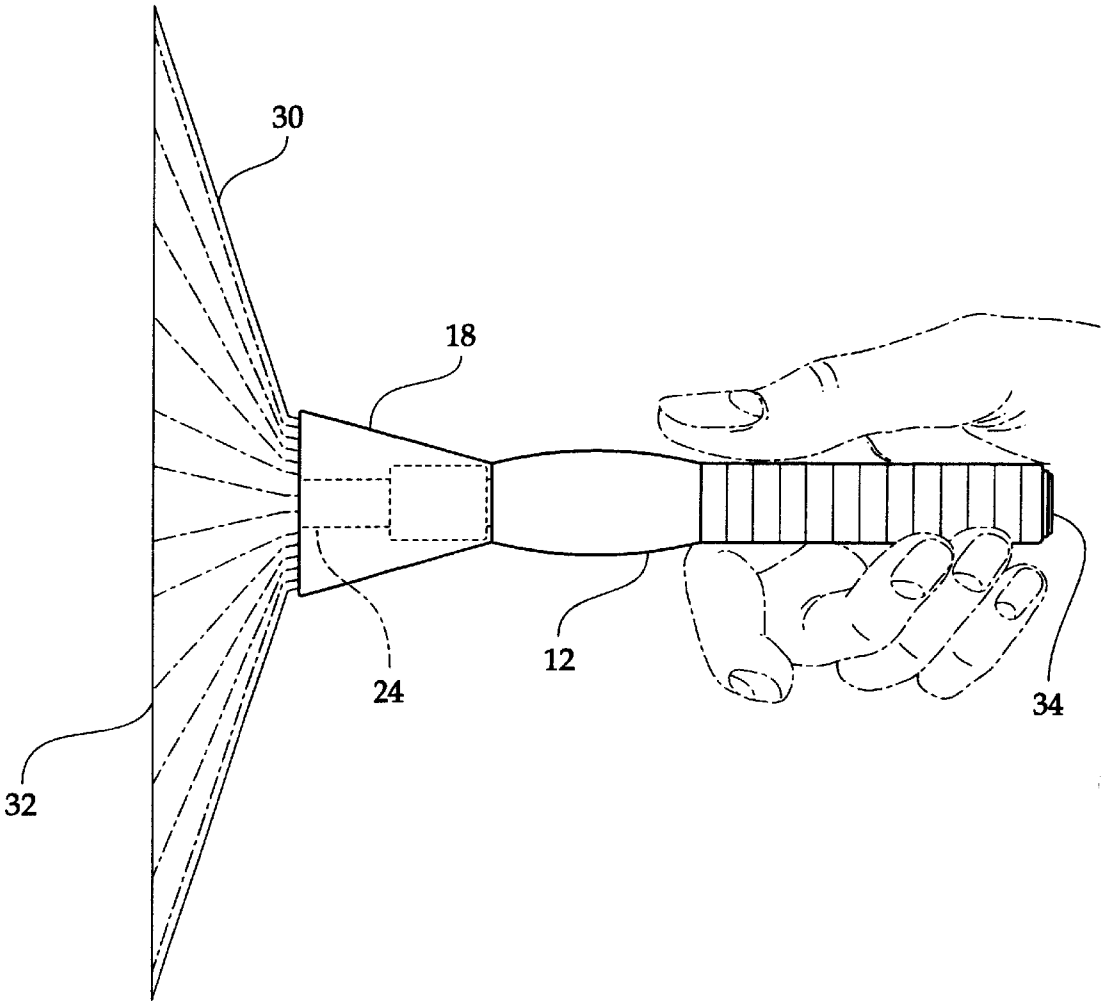
FIG. 2 is a side view of the present invention illustrated in use.
Figure 2:
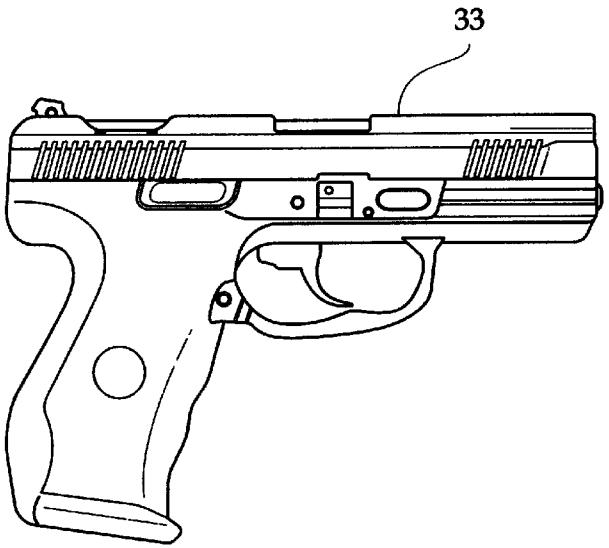

With reference now to the drawings, and in particular, to FIGS. 1 through 2 thereof, the preferred embodiment of the new and improved protective face shield with incorporated laser light embodying the principles and concepts of the present invention and generally designated by the reference number 10 will be described.

Specifically, it will be noted in the various Figures that the device relates to a protective face shield with incorporated laser light for protecting a user's face from an assailant shooting a gun as well as providing means to temporarily blind the assailant. In its broadest context, the device consists of a handle portion, a laser generating device, a protective shield, and an activation button. Such components are individually configured and correlated with respect to each other so as to attain the desired objective.

The handle portion 12 has a generally cylindrical configuration. The handle portion 12 has an inner end 14 and an outer end 16. The outer end 16 has a frustoconical collar 18 extending outwardly therefrom. The frustoconical collar 18 has an open outer end 20. The handle portion 12 includes a knurled inner gripping portion 22.

The laser-generating device 24 is disposed within the frustoconical collar 18 of the handle portion 12. The laser generating device 24 has an activated orientation whereby a ray of light 26 is directed outwardly through the open outer end 20 of the frustoconical collar 18. The laser-generating device 24 is provided with an aperture 28 that allows the ray of light 26 to be directed out thereof.

The protective shield 30 is disposed within the frustoconical collar 18 of the handle portion 12 in a retracted orientation. Note FIG. 1. The protective shield 30 extends outwardly of the collar 18 in a deployed orientation in a fan-like configuration. Note FIG. 2. The protective shield 30, in the deployed orientation, forms a concave outer surface 32 having a reflective layer disposed thereon. The reflective layer will serve to amplify and intensify the ray of light 26. The protective shield 30 is constructed of a material that is impervious to bullets fired by a pistol 33.

The activation button 34 is disposed within the inner end 14 of the handle portion 12. The activation button 34 is in communication with the laser generating device 24 and the protective shield 30. Once depressed, the activation button 34 will cause the protective shield 30 to deploy and the laser generating device 24 to direct the ray of light 26 out through the open outer end 20 of the collar 18.

In use, a person utilizing the device 10 will press the activation button 34 when an assault is about to occur. The user will raise the device 10 upwardly so that the protective shield 30 will be in position between themselves and the pistol 33. Alternately, when the user is not in danger of being shot, he can simply direct the ray of light 26 into the assailant's eyes to cause temporary blindness.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A protective face shield with incorporated laser light for protecting a user's face from an assailant shooting a gun as well as providing means to temporarily blind the assailant comprising, in combination:

a handle portion having a generally cylindrical configuration, the handle portion having an inner end and an outer end, the outer end having a frustoconical collar extending outwardly therefrom, the frustoconical collar having an open outer end, the handle portion including a knurled inner gripping portion;

a laser generating device disposed within the frustoconical collar of the handle portion, the laser generating device having an activated orientation whereby a ray of light is directed outwardly through the open outer end of the frustoconical collar;

a protective shield disposed within the frustoconical collar of the handle portion in a retracted orientation, the protective shield extending outwardly of the collar in a deployed orientation in a fan configuration, the protective shield in the deployed orientation forming a concave outer surface having a reflective layer disposed thereon; and an activation button disposed within the inner end of the handle portion, the activation button being in communication with the laser generating device and the protective shield.

2. A protective face shield with incorporated laser light for protecting a user's face from an assailant shooting a gun as well as providing means to temporarily blind the assailant comprising, in combination:

a handle portion having an inner end and an outer end, the outer end having a frustoconical collar extending outwardly therefrom, the frustoconical collar having an open outer end;

a laser generating device disposed within the frustoconical collar of the handle portion, the laser generating device having an activated orientation whereby a ray of light is directed outwardly through the open outer end of the frustoconical collar;

a protective shield disposed within the frustoconical collar of the handle portion in a retracted orientation, the protective shield extending outwardly of the collar in a deployed orientation.

3. The protective face shield with incorporated laser light as set forth in claim 2, wherein the handle portion includes a knurled inner gripping portion.

4. The protective face shield with incorporated laser light as set forth in claim 2, wherein the protective shield extends outwardly of the collar in the deployed orientation in a fan configuration.

5. The protective face shield with incorporated laser light as set forth in claim 4, wherein the protective shield, in the deployed orientation, forms a concave outer surface having a reflective layer disposed thereon.

6. The protective face shield with incorporated laser light as set forth in claim 2, and further including an activation button disposed within the inner end of the handle portion, the activation button being in communication with the laser generating device and the protective shield.

* * * * *